US007418766B2

(12) United States Patent
Nelson et al.

(10) Patent No.: US 7,418,766 B2
(45) Date of Patent: Sep. 2, 2008

(54) HINGE WITH TANDEM PIVOT STRUCTURE MOTION LOCK AND OVERRIDE

(75) Inventors: Aaron T. Nelson, West Linn, OR (US); Keng Leong Ng, Singapore (SG); Brent R. Jones, Tualatin, OR (US); Yin Mei (Regina) Sia, Singapore (SG); Sheau Ming Ng, Singapore (SG)

(73) Assignee: Xerox Corporation, Norwalk, CT (US)

( * ) Notice: Subject to any disclaimer, the term of this patent is extended or adjusted under 35 U.S.C. 154(b) by 635 days.

(21) Appl. No.: 11/018,531

(22) Filed: Dec. 22, 2004

(65) Prior Publication Data

US 2006/0130277 A1 Jun. 22, 2006

(51) Int. Cl.
*E05D 7/06* (2006.01)

(52) U.S. Cl. ..... 16/239; 16/286; 16/354; 16/366; 16/369

(58) Field of Classification Search ..... 16/239, 16/237, 236, 287, 286, 289, 290, 292, 302, 16/303, 366, 368, 369; 361/680–683; 455/575.1, 455/575.3, 575.4, 575.8, 550.1, 90.3; 355/75; 358/497, 498; 399/377, 379, 380
See application file for complete search history.

(56) References Cited

U.S. PATENT DOCUMENTS 4,520,977 A * 6/1985 Holzhauser et al. ..... 248/201
4,556,308 A 12/1985 Hoppner et al.
4,742,598 A * 5/1988 Bruneau ..... 16/286
4,814,817 A * 3/1989 Nishijima et al. ..... 399/125
5,003,347 A * 3/1991 Kameda ..... 355/75
5,060,019 A 10/1991 Fukunaga
5,162,846 A 11/1992 Cahill
5,265,310 A 11/1993 Ichinokawa
5,361,184 A * 11/1994 El-Sharkawi et al. ..... 361/93.6
5,564,163 A 10/1996 Lowry et al.
6,092,847 A 7/2000 Kwan
6,175,990 B1 1/2001 Kato et al.
6,243,884 B1 6/2001 Simonson
6,427,500 B1 8/2002 Weinerman et al.

(Continued)

FOREIGN PATENT DOCUMENTS

JP 2003005309 A * 1/2003

*Primary Examiner*—Chuck Y. Mah
(74) *Attorney, Agent, or Firm*—Oliff & Berridge, PLC

(57) ABSTRACT

An upper piggybacked unit of a tandem unit is provided with a hinge unit and at least one motion lock to prevent the upper unit from falling away from the lower unit when it is tandemly coupled to the lower unit and the lower unit is pivoted to a non-horizontal position. The motion lock may inhibit rotation and/or translation of the upper unit. The motion lock may also be self-actuating, such as a gravity dependent lock mechanism. A lock override mechanism may be provided to allow the lock to yield to excessive force without causing damage. The lock enable condition may be automatically reset after the override condition so that no special knowledge or action on the part of the user is required to return the hinge to normal operation. The motion locks are particularly useful when provided on a reprographic device, such as a copier, facsimile, printer or malfunction device having an upper unit that forms a sheet feeder unit, a lower unit that forms a scan housing, and a fixed base below the lower unit that may contain a marking engine.

19 Claims, 12 Drawing Sheets

U.S. PATENT DOCUMENTS 6,499,189 B2 12/2002 Kondo et al.
6,510,301 B2 1/2003 Tanaka
6,615,019 B2 9/2003 Fujimoto
7,299,525 B2 * 11/2007 Chang ..... 16/327

* cited by examiner

HINGE WITH TANDEM PIVOT STRUCTURE MOTION LOCK AND OVERRIDE

BACKGROUND OF THE INVENTION

1. Field of Invention

The invention relates to a hinge assembly for use in a tandem pivot structure that has one or more tandem motion locks and a lock override. The hinge assembly is particularly suited for use in a reprographic device having two separately rotatable units provided in a piggyback fashion.

2. Description of Related Art

Printers, copiers, facsimiles and other reprographic products typically have a cover or structural housing that has to be pivoted open to gain access to internal components, such as for ink or toner replenishment, media jams, etc. Copiers and multifunctional printers and devices with printing, scanning and/or copying functions have additional requirements for pivoting covers. Such multifunction devices besides having printing mechanisms may also include scanning mechanisms and may have a feed unit with automatic document feeding mechanisms. The feed unit is normally oriented in a nearly horizontal position. Such feed units must be pivoted open to access a scanner platen glass for document copying or media jam recovery.

The feed unit may be tandemly coupled in piggyback fashion to a lower structure, which incorporates the scanner and also pivots. This lower scanner unit is also normally oriented in a nearly horizontal position. An example of this is shown in simplistic form in FIGS. 1-2. Printer device 100 includes an upper rotatable feed unit 110 coupled to a rotatable lower scanner unit 130 through a first coupling hinge 120. The rotatable lower scanner unit 130 is rotatable relative to the lower base of printer 100 through a second coupling hinge 140. Thus, two tandem hinges are provided that can each be independently rotated. However, when the lower scanner unit 130 is pivoted fully open to provide access to the interior of the printer device 100, a problem may arise as shown in FIG. 2. That is, the upper feeder unit 110 may want to pivot further, possibly falling behind the device due to the influence of gravity and/or inertial motion caused by the opening of the lower scanner unit.

If the lower scanner unit is intended to accommodate books with the upper feeder unit closed, a vertical slide or elevating range can be provided to accommodate the thickness of the book on the scanner unit. Such an elevating capability can create additional problems when the scanner unit is opened fully because now the feeder unit, if not restrained, can extend in translation backwards with undesired force and consequences, due to gravity and momentum.

When an unrestrained feeder unit 110 falls backwards due to pivot motion allowed by the first coupling hinge 120 or by unrestrained translation of an elevating slide, the feeder unit 110 can strike a wall behind the printer device 100, or a person walking behind it. Moreover, when the feeder unit 110 freely falls backwards, the feeder unit 110, first connecting hinge 120 and/or hinge mounting components can be bent or damaged.

All of these problems are brought about due to integration of functions added to printers when they require multipurpose functionality. User interface unpredictability can also be part of the problem. Users of the device may ignore motion tendencies of the various cover mechanisms they are opening. The propensity to be casual and inattentive when opening and handling of the various device units being pivoted can lead to yet another problem. The hinge may not be opened far enough to optimally accomplish the desired task, such as jam removal or ink replenishment.

Accordingly, structures for accommodating tandem pivoting units may suffer from various problems.

SUMMARY OF THE INVENTION

In accordance with a first aspect of the invention, at least one motion lock is provided on the upper piggybacked unit of a tandem unit to prevent the upper unit from falling away from the lower unit when it is tandemly coupled to the lower unit and the lower unit is pivoted to a non-horizontal position.

In various exemplary embodiments, this aspect is achieved using a gravity dependent lock mechanism. Moreover, in a preferred embodiment, the lock is self-actuating and self-releasing upon sufficient pivoting of the upper and lower units.

In various exemplary embodiments, the motion lock prevents rotational movement of the upper unit relative to the lower unit. In other various exemplary embodiments, the motion lock prevents translatory motion of the upper unit relative to the lower unit. In a preferred embodiment, motion locks are provided that prevent both rotational and translatory movement of the upper unit relative to the lower unit. In a more preferred embodiment, the motion locks are automatically enabled or disabled so that no special knowledge or action on the part of the user is required to return the hinge to normal operation.

In various exemplary embodiments a hinge pivot motion lock for a hinge that tandemly couples an upper unit to a lower unit will automatically inhibit pivot motion of the upper unit as the lower unit is pivoted into an intermediate range of positions between a first position (e.g., a closed position) and a second position. Moreover, the motion lock will automatically disengage and allow the upper unit to pivot freely when the lower unit is oriented at or near the first position, such as a closed substantially horizontal position.

This motion lock solution, however, may lead to another problem. When the large geometry of the typical media feed mechanism forming the upper unit is grasped by a user, the leverage advantage and torque that can be applied in opposition to a locking position that is near a pivot center of the hinge can be tremendous. Users are not very likely to intentionally open the unit with excessive force. However, because of this leverage, the unit could inadvertently be opened with force that would otherwise damage or break the lock mechanism locking the hinge to a vertical position. This may break the hinge mount or other components of the device.

In accordance with a second aspect of the invention, a lock override mechanism is provided to reduce or prevent the above problem. Such a lock override mechanism allows the lock to yield to excessive force without causing damage. In a preferred embodiment, the lock enable condition is automatically reset after the override condition so that no special knowledge or action on the part of the user is required to return the hinge to normal operation.

In exemplary embodiments, the motion locks are provided on a reprographic device, such as a copier, facsimile, printer or multifunction device having an upper unit that forms a sheet feeder unit, a lower unit that forms a scan housing, and a fixed base below the lower unit that may contain a marking engine.

In accordance with a further aspect of the invention, the various motion locks and/or override mechanisms are provided inside an exterior housing of the hinge assembly so that, with a cursory glance, the hinge assembly has the outward visual appearance of an ordinary hinge. Besides improved aesthetics, this elimination of external linkages, release catches, etc. can remove sources of potential interference that would otherwise impede proper operation of the device, and can improve product safety.

BRIEF DESCRIPTION OF THE DRAWINGS

Various exemplary embodiments will be described in detail, with reference to the following figures, wherein.

DETAILED DESCRIPTION OF PREFERRED EMBODIMENTS

Figure 1:
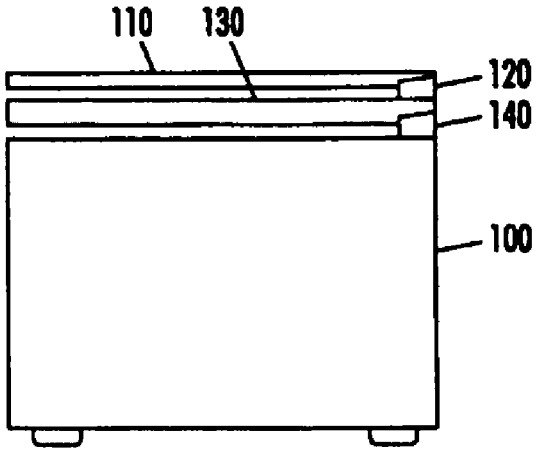
FIG. 1 RELATED ART
FIG. 1 illustrates a conventional reprographic device comprising a tandem pivot structure in which two separate pivoting units are tandemly coupled and independently rotatable.
Figure 2:
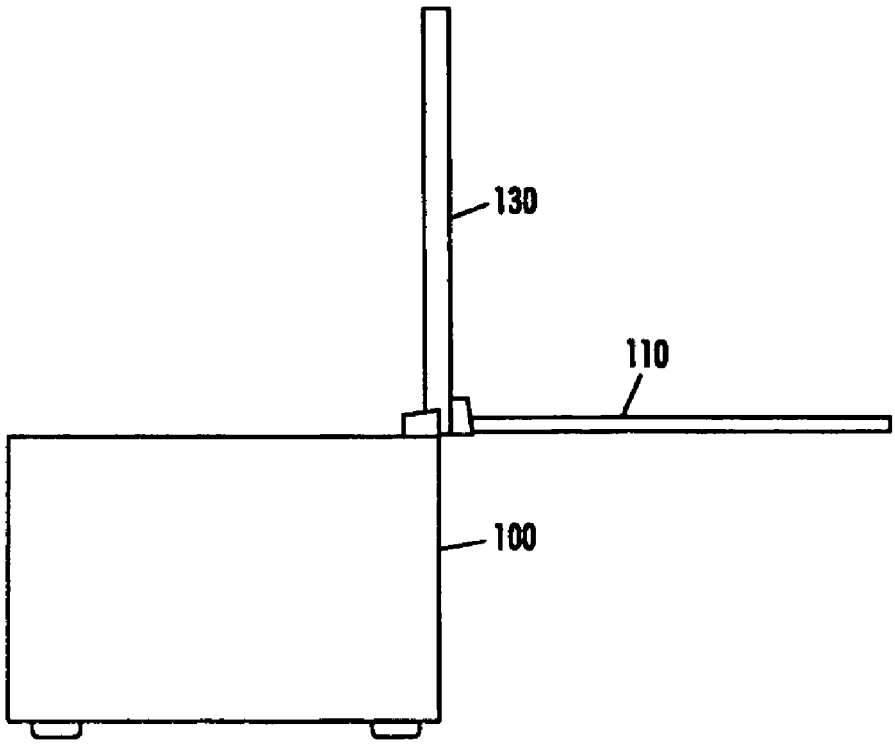
FIG. 2 RELATED ART
FIG. 2 illustrates the conventional reprographic device of FIG. 1 when the lowermost pivotable unit has been fully raised to a substantially vertical position and the uppermost unit is indirectly moved to an undesirable position as a result of movement of the lowermost pivotable unit.
Figure 3:
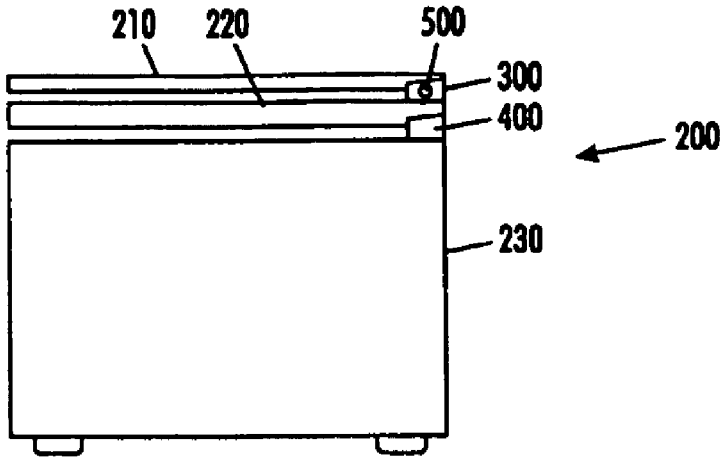
FIG. 3 illustrates an exemplary reprographic device according to an embodiment of the invention comprising a tandem pivot structure in which two separate pivoting units are tandemly coupled and rotatable, in which an upper hinge is provided with at least one motion lock that is dependent on the orientation of the lower unit for actuation.
Figure 4:
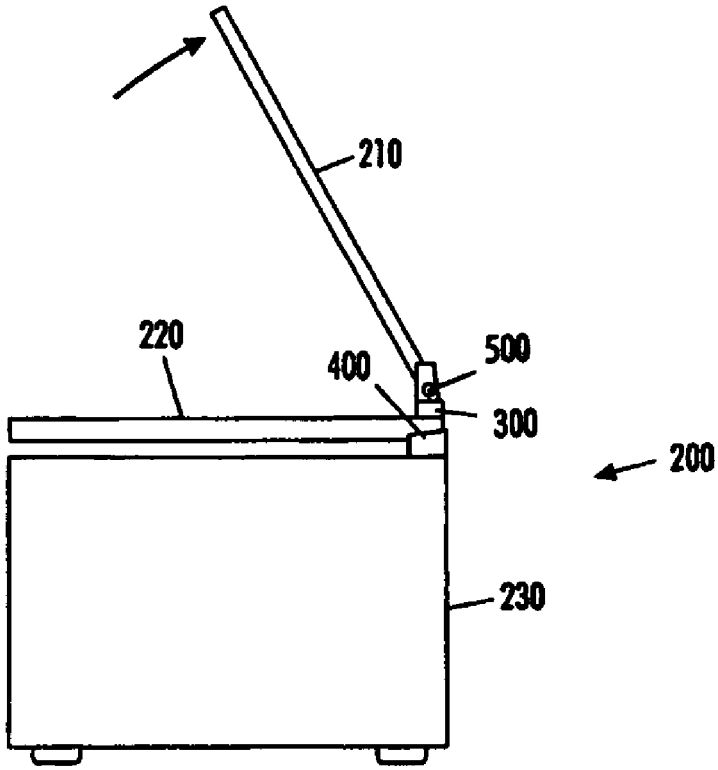
FIG. 4 illustrates the exemplary reprographic device of FIG. 3 when the lowermost pivotable unit remains closed and the upper most pivotable unit is independently positioned in an open position.
Figure 5:
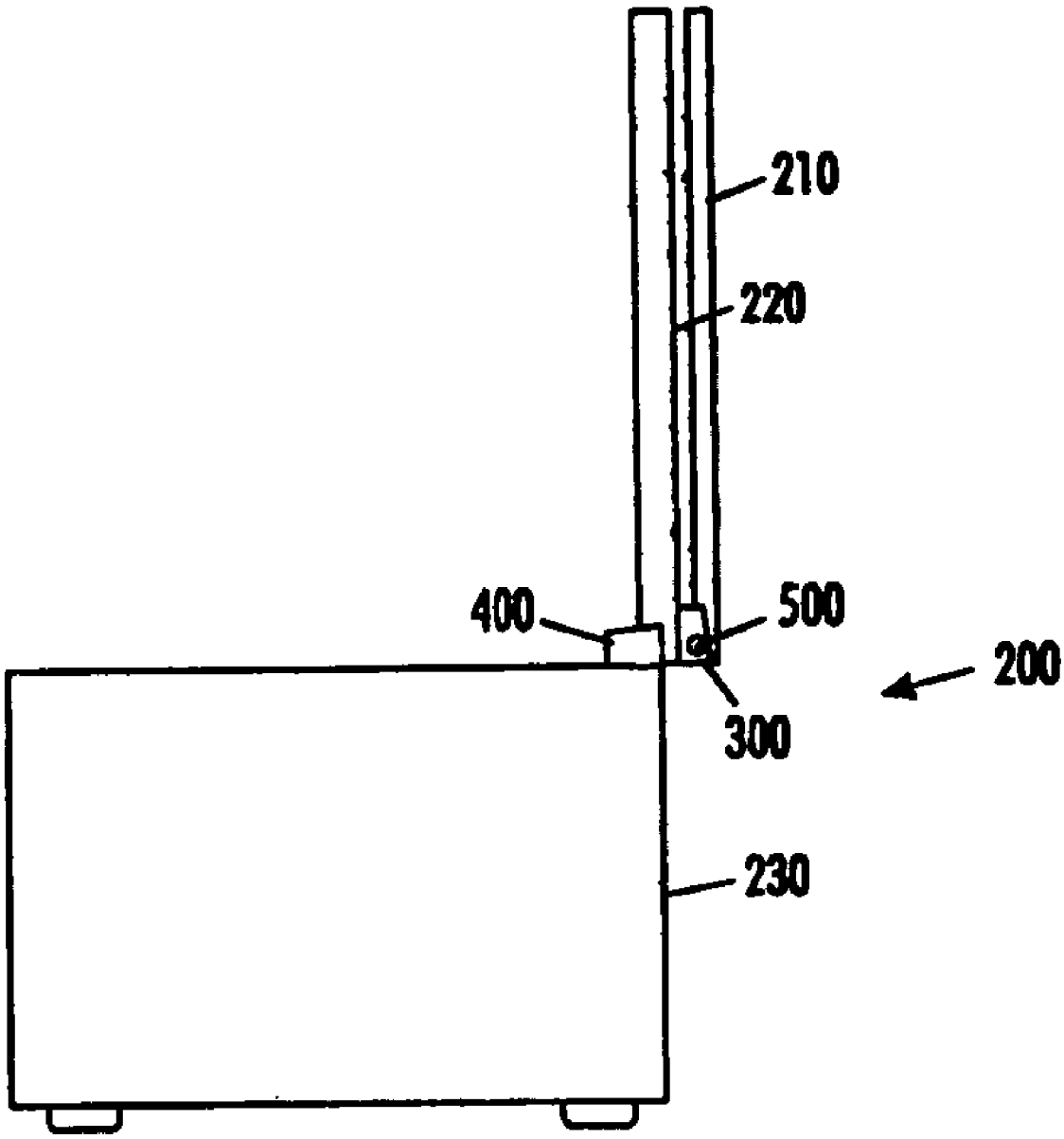
FIG. 5 illustrates the reprographic device of FIG. 3 when the lowermost pivotable unit has been fully raised to a substantially vertical position and the uppermost unit is constrained against inadvertent pivotal and/or translational motion by the at least one motion lock.

FIGS. 3-5 illustrate an exemplary tandem pivoting device 200 useable with various exemplary embodiments of the systems and methods described. In an exemplary embodiment, device 200 may be a reprographic device, such as a copier, printer, facsimile, or other similar device, and is preferably a multifunction device capable of scanning, as well as providing copying, printing, and/or facsimile transmission functionality. Reprographic device 200 includes an upper pivoting unit 210, a lower pivoting unit 220, a first coupling hinge assembly 300 that pivotally couples the upper pivoting unit 210 to the lower pivoting unit 220, and a second coupling hinge assembly 400 that pivotally couples the lower unit 220 relative to a base 230 of the device.

The upper pivoting unit 210 may form an upper feeder unit having an auto feeding module that advances a recording media, such as paper, past a scanning head or scan platen. In an exemplary embodiment, the lower pivoting unit 220 forms a lower scan unit that contains the scanner platen. The scanned images can be reproduced by a marking engine provided in, for example, base 230.

First coupling hinge assembly 300 allows rotational movement of upper pivot unit 210 between a substantially horizontal closed position (FIG. 3) and a substantially vertical fully open position (FIG. 4). However, unit 210 may also be positioned at one or more intermediate positions. Second coupling hinge assembly 400 likewise allows rotation of lower pivoting unit 220 between a closed substantially horizontal position (FIG. 3) and an open position (FIG. 5), which could be a fully open substantially vertical position, but preferably is a position less than vertical but sufficient to enable access to lower base device 230. Unit 220 may also be opened to one or more intermediate positions. Although second coupling hinge assembly 400 can operate independent of operation of the first coupling hinge assembly 300, first coupling hinge assembly 300 has movement operations that are at least partially dependent on the orientation or operation of the lower pivoting unit 220.

One important feature of this is shown in FIG. 5 where during opening of the lower pivoting unit 220 to a non-horizontal position, the first coupling hinge assembly 300 has its motion constrained by a first motion lock 500, to be described later in more detail with reference to FIGS. 12 and 14. This first motion lock 500 in an exemplary embodiment constrains further rotation of the upper feeder unit 210 relative to lower scan unit 220 and is preferably a gravity-actuated lock. Accordingly, when the lower scan unit 220 is opened, the upper feeder unit will not inadvertently fall away from the scan unit.

Figure 6:
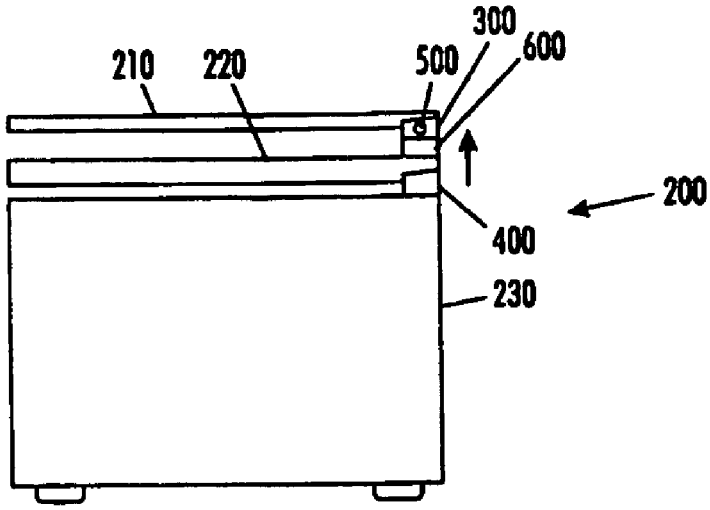
FIG. 6 illustrates an exemplary reprographic device according to an embodiment of the invention comprising a tandem pivot structure in which two separate pivoting units are tandemly coupled and rotatable, in which an upper unit is capable of vertical translatory movement and provided with at least one motion lock, which is dependent on the orientation of the lower unit.
Figure 7:
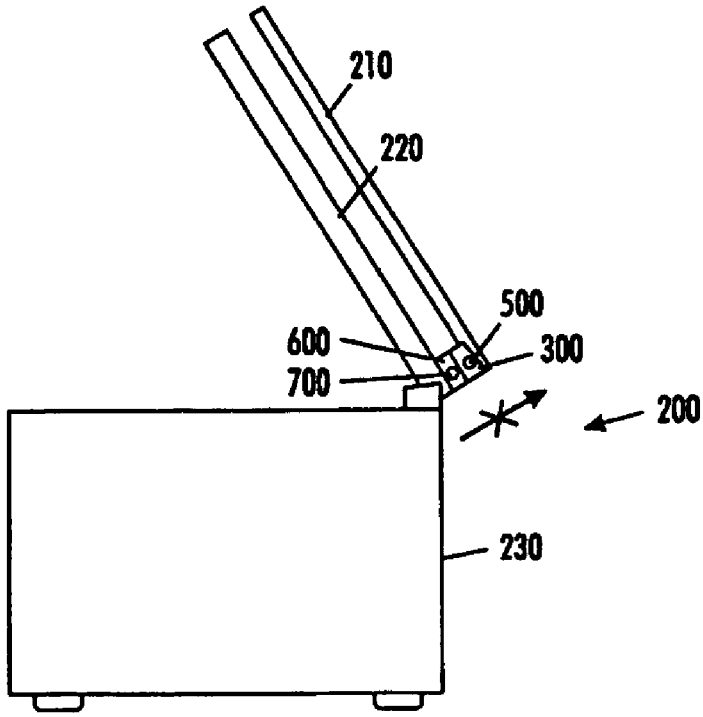
FIG. 7 illustrates the reprographic device of FIG. 6 when the lowermost pivotable unit is being raised to a pivoted non-horizontal position and the uppermost unit is constrained against inadvertent translational motion by the at least one motion lock.

With reference to FIGS. 6-7, the exemplary tandem pivoting reprographic device 200 may further include an elevator slide mechanism 600 capable of freely translating the upper unit 210 substantially perpendicular to the lower unit 220 in the direction of the arrow. In this example, movement is substantially vertical. In the context of a reprographic device 200, the upper unit 210 may be a cover or feeder unit that covers a scanning platen provided on the lower scan unit 220. When copying individual sheets, upper unit 210 can be located very near lower scan unit 220. However, to accommodate copying of a book or other thick document, it is necessary for the upper unit 210 to be extendible to accommodate the book while the upper unit 210 remains closed.

A problem arises that during the opening of the lower unit (i.e., movement to a non-horizontal position), the elevator slide mechanism 600 may be inadvertently translated due to gravity, inertia and the like. To prevent this from occurring, another aspect of the invention provides a second motion lock 700 that constrains translational movement of the elevator slide 600 (i.e., substantially limits or prevents unconstrained movement in the direction of the arrow) when the lower scan unit 220 is moved to a non-horizontal position. Second motion lock may also allow some limited degree of motion to occur before engagement. The second motion lock 700 will be described later in more detail with reference to FIGS. 13 and 14 and also is preferably a gravity-dependent lock.

Figure 8:
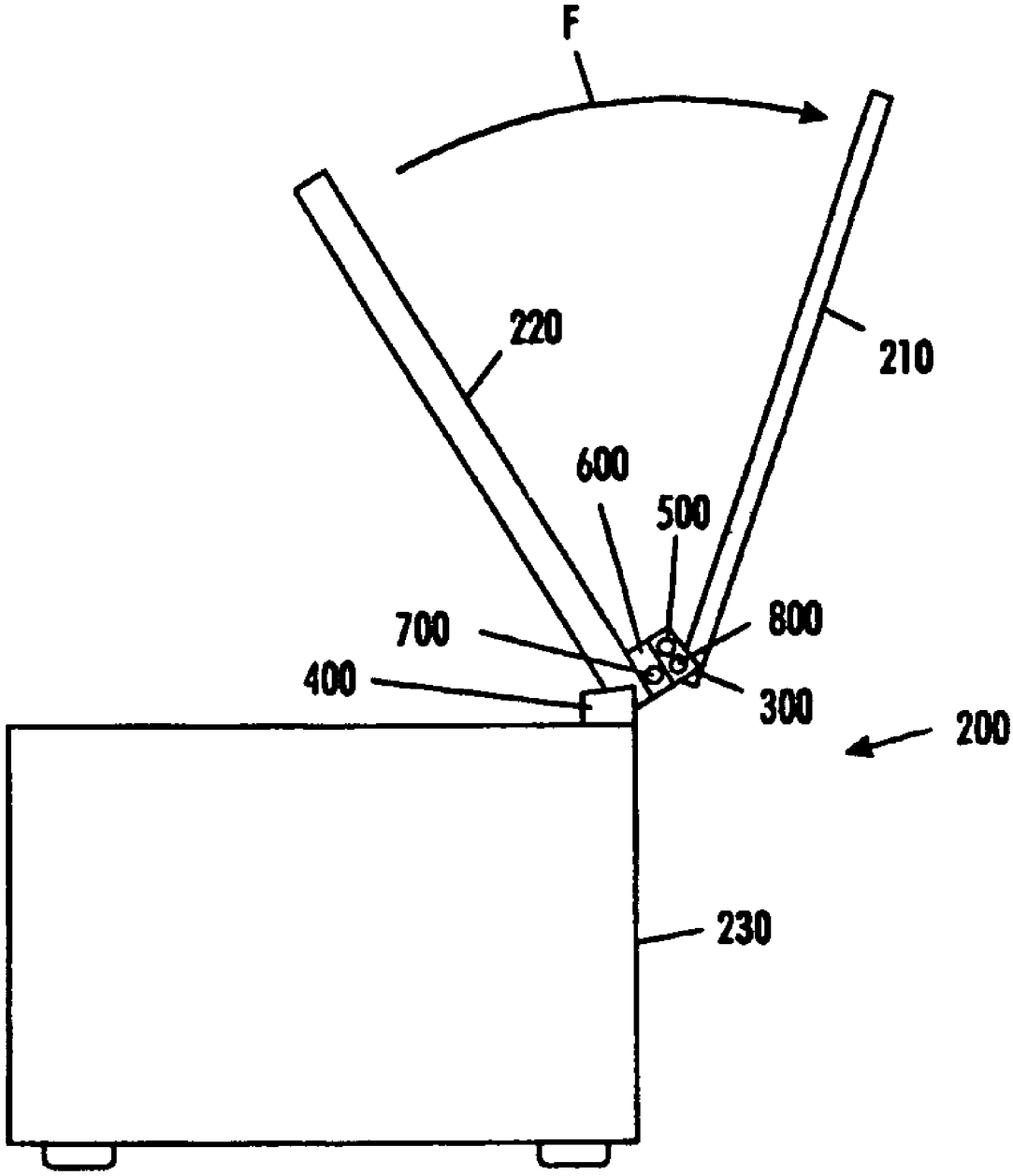
FIG. 8 illustrates an exemplary reprographic device according to an embodiment of the invention in which the tandem pivot structure is further provided with an override feature that overrides the motion lock to allow the upper unit to pivotably break away from the lower unit upon receiving a sufficient force.

With reference to FIG. 8, another aspect of the hinge is the provision of an override mechanism 800 that overrides the constraint acting on the first coupling hinge assembly 300 by at least the first motion lock 500. For example, when no or little force F is directly applied to the upper unit 210 during opening of the lower unit, the device operates as illustrated in FIG. 5. However, when an urging force F of sufficient strength acts on the upper unit 210 itself in a direction opposing constraint by the first motion lock 500, it is possible that such force may break or damage one or more hinge assembly components or the upper unit 210 itself. This is particularly the case when the upper unit 210 has a large geometry, as in a typical media feed mechanism. With such a large geometry, the leverage advantage and torque that can be applied in opposition to the locking function, which is provided near the pivot center, is very large and it is quite possible that a sufficiently large force would be inadvertently applied. To reduce the possibility for such damage, the override mechanism 800 allows for movement of the upper unit 210 relative to the second unit 220 and a release of the first motion lock 500. Preferably, upon reduction or elimination of the urging force F, the override mechanism 800 will automatically release, enabling the first motion lock 500 to again constrain movement as desired.

With reference to the preceding Figures, the first coupling hinge assembly 300 and/or hinge assembly 400 may be a counter balance style spring loaded hinge that is capable of retaining the unit open in intermediate positions by a designed counterbalance of spring force relative to weight and geometry. Either unit 210 or 220 may be capable of self-bias towards the open position (auto-open) when the unit is positioned sufficiently close to the open position. Additional features will be described with reference to FIG. 16.

Figure 9:
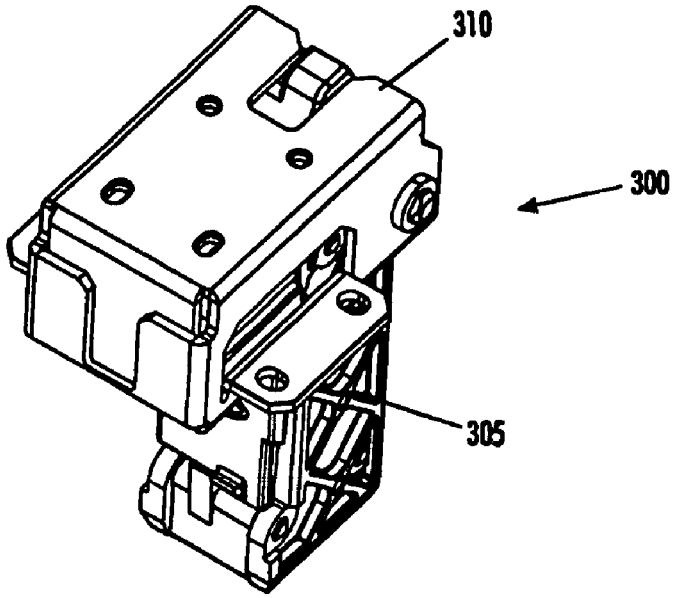
FIG. 9 illustrates an exemplary embodiment of a preferred upper hinge assembly in a closed position.
Figure 10:
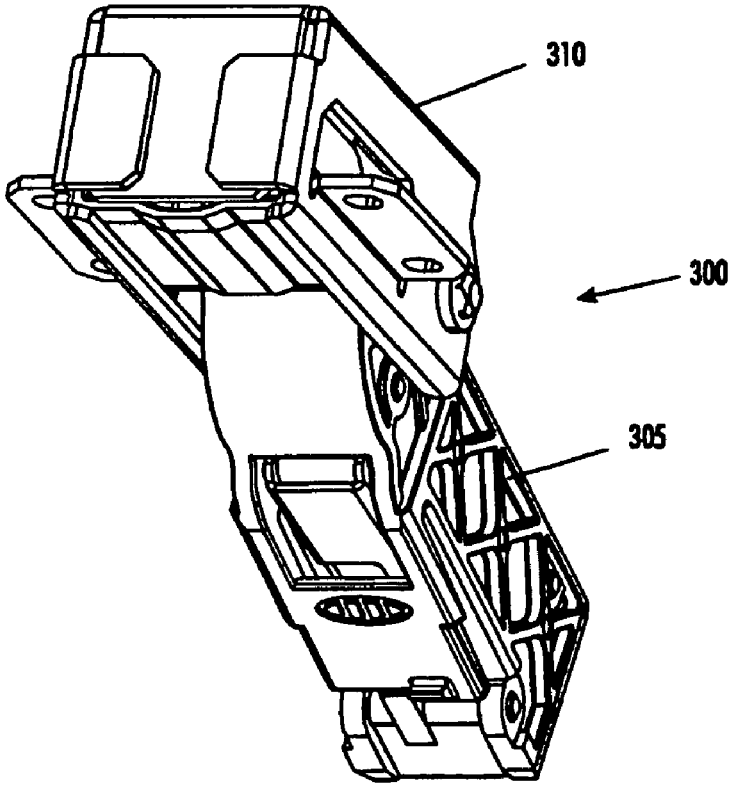
FIG. 10 illustrates an exemplary embodiment of the upper hinge assembly of FIG. 9 in a fully open position.
Figure 11:
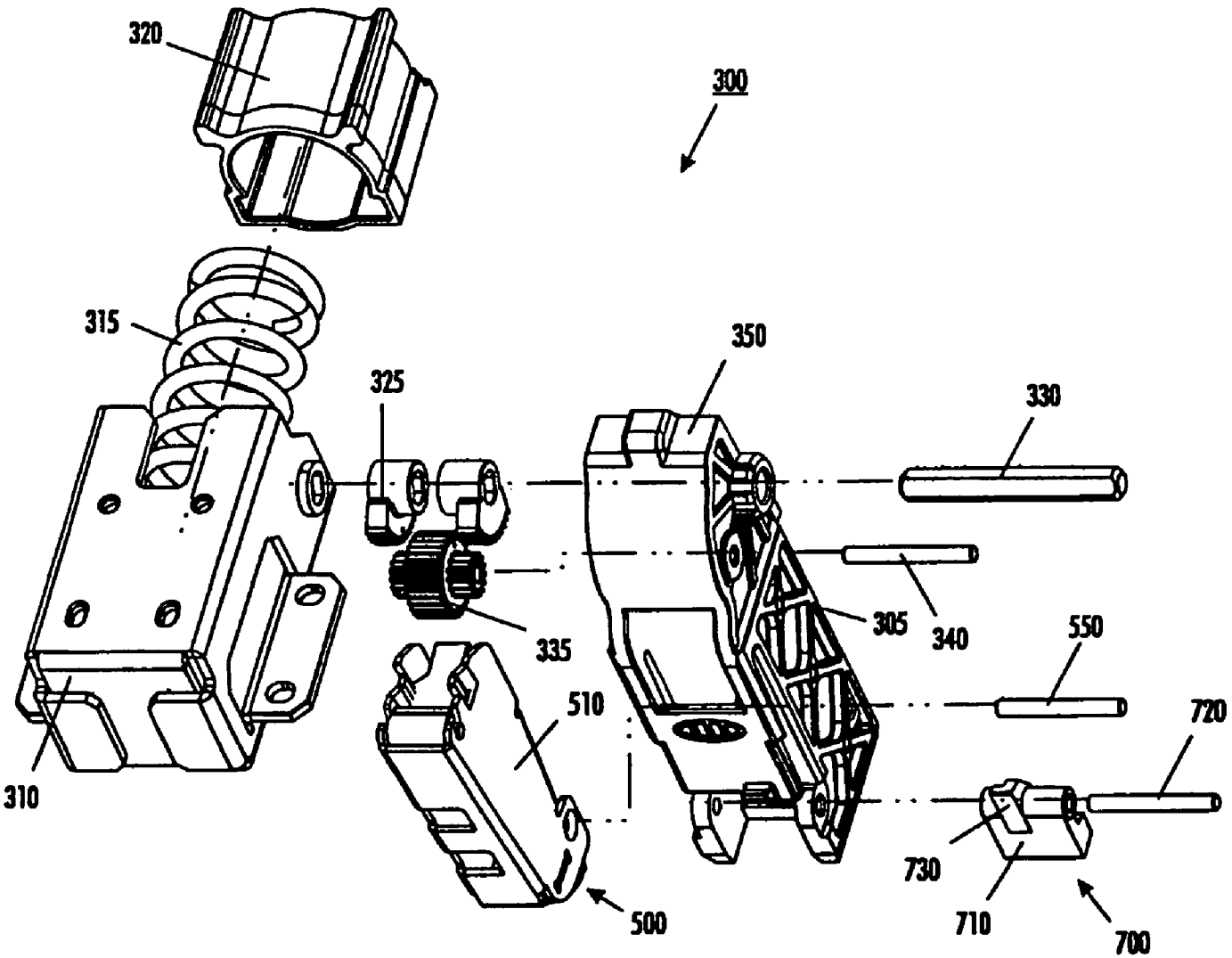
FIG. 11 illustrates an exploded view of the hinge assembly of FIGS. 9-10.

FIGS. 9-11 illustrate an exemplary coupling hinge assembly 300 according to an embodiment of the invention. Hinge 300 includes a lower hinge housing 305 and upper hinge housing 310. Upper housing 310 includes an upper housing cam follower tension spring 315 and a cam follower plunger 320. Upper housing 310 is connected to lower housing 305 through a gear assembly that includes gear sectors 325 mounted on gear sector shaft 330 and triple gear 335 mounted on triple gear shaft 340.

Lower housing 305 includes an upper surface that forms a cam profile 350 with a suitable cam contour to guide cam follower 320 and control the movement of the upper housing 310 of hinge assembly 300 relative to the lower housing 305. Additional details of the cam profile will be described later with respect to FIG. 16.

Lower housing 305 is preferably hollow and contains a first motion lock 500 substantially within its interior confines. First motion lock 500 includes a motion lock housing 510 that is pivotally mounted within lower housing 305 by pivot shaft 550 provided in the lower half of lock housing 510. First motion lock 500 is designed to be oriented in a first position remote from the gear assembly when the lower housing 305 is substantially vertically oriented. However, when the lower housing is tilted in a first direction, the motion lock assembly pivots into a second position in which it engages one or more components of the gear assembly 335 to lock the upper housing 310 from rotation relative to the lower housing 305, as will be described in further detail below.

A second motion lock 700 is also provided in lower housing 305 and includes a body element comprised of a lower body portion 710 and an upper body portion 730 pivotally mounted on a pivot shaft 720. The lower body is shaped, weighted or otherwise configured to be heavier than the upper body.

A more detailed explanation of the hinge assembly 300 will be described with reference to FIGS. 12-15. In FIG. 12, the hinge assembly 300 is shown in a standard operating position in which the lower unit 220 is closed (e.g., in a substantially horizontal position), the lower housing 305 is in a substantially vertical position, and the upper housing 310 attached to upper unit 210 is free to pivot upward in the direction of the arrow, or return to a closed position. When in this shown orientation, the first motion lock 500 becomes positioned by virtue of its center of gravity in a normal position where pivot lock 540 is disengaged from the gear assembly, and in particular displaced relative to gear 335 (i.e., displaced laterally as shown). Thus, the gear assembly (gear 335 and gear segments 325) is free to rotate when a force is applied to the upper unit 210. Also, the lock function is inhibited automatically when the lower unit is closed.

Figure 14:
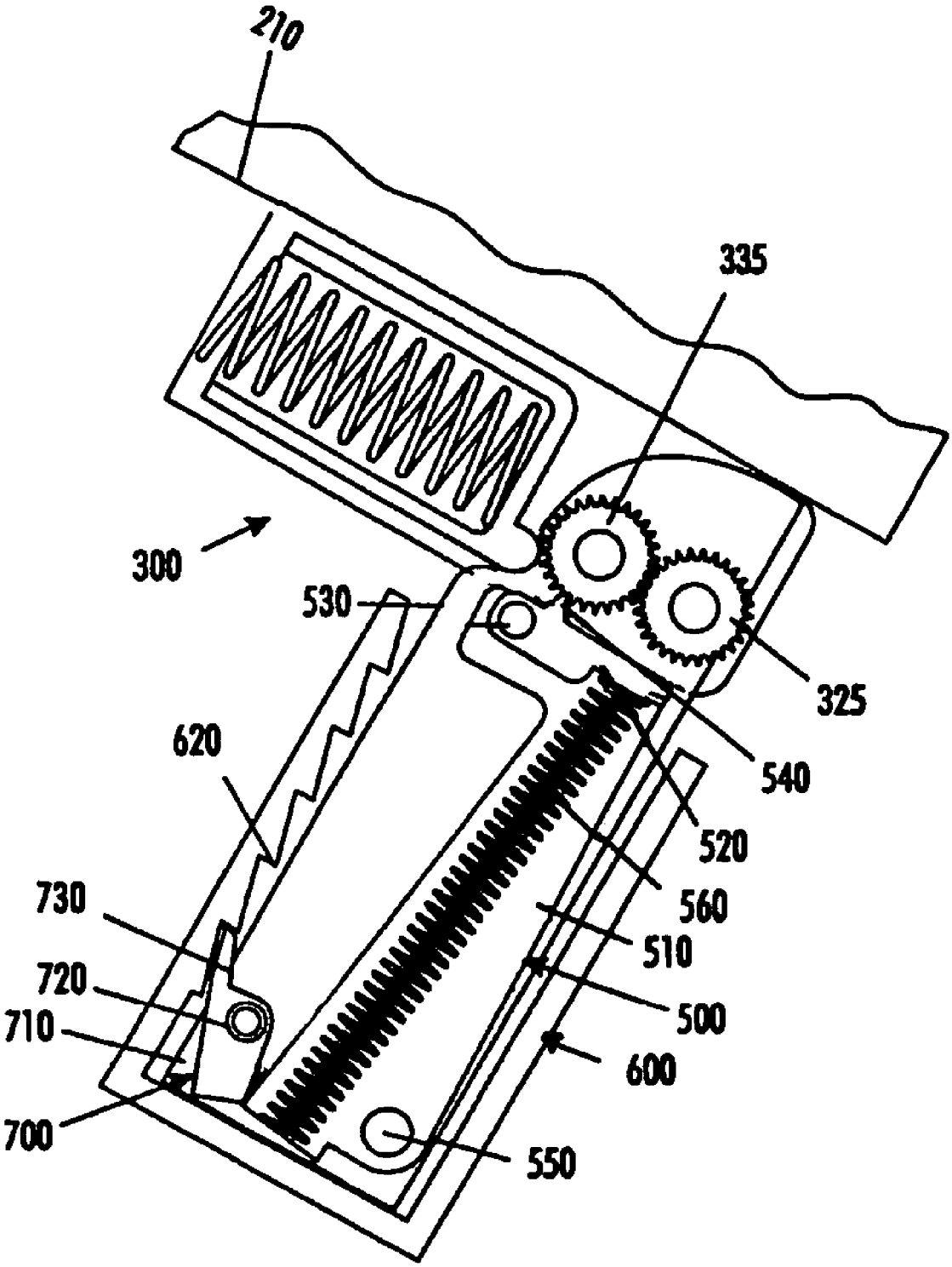
FIG. 14 illustrates a partial cut-away view of the upper hinge assembly according to a preferred embodiment in a non-raised position relative to the lower unit and the lower unit of the reproduction device being in a raised, non-horizontal position in which a first motion lock mechanism prevents rotation of the upper unit relative to the lower unit and a second motion lock mechanism prevents translational movement of the upper unit relative to the lower unit.

A preferred embodiment uses gear 335 provided on hinge pivot shaft 340 that is engaged by a pivot lock 540 of the spring-loaded pivot arm 520 when the hinge is pivoted at an elevated angle best viewed in FIG. 14. When the pivot lock 540 engages gear 335, pivot motion is inhibited, accomplishing the intended lock function. Other structures are possible, such as the use of compound or tandem gears to achieve a desired force ratio or strength. Alternatively, gear-like teeth may be provided over only a functional segment of a rotating component.

The upper unit is rotatable between closed and fully opened positions, which may be defined by the configuration of cam profile 350 and associated cam follower 320, which may include a cam follower surface 322. Additionally, by selection of a suitable spring force range for spring 315, the hinge assembly can be of the counter balance type that can retain the assembly positioned in an intermediate position, such as the position shown in FIG. 12. Of course, the spring size and force will depend on the weight and leverage applied by the upper unit 210.

Figure 12:
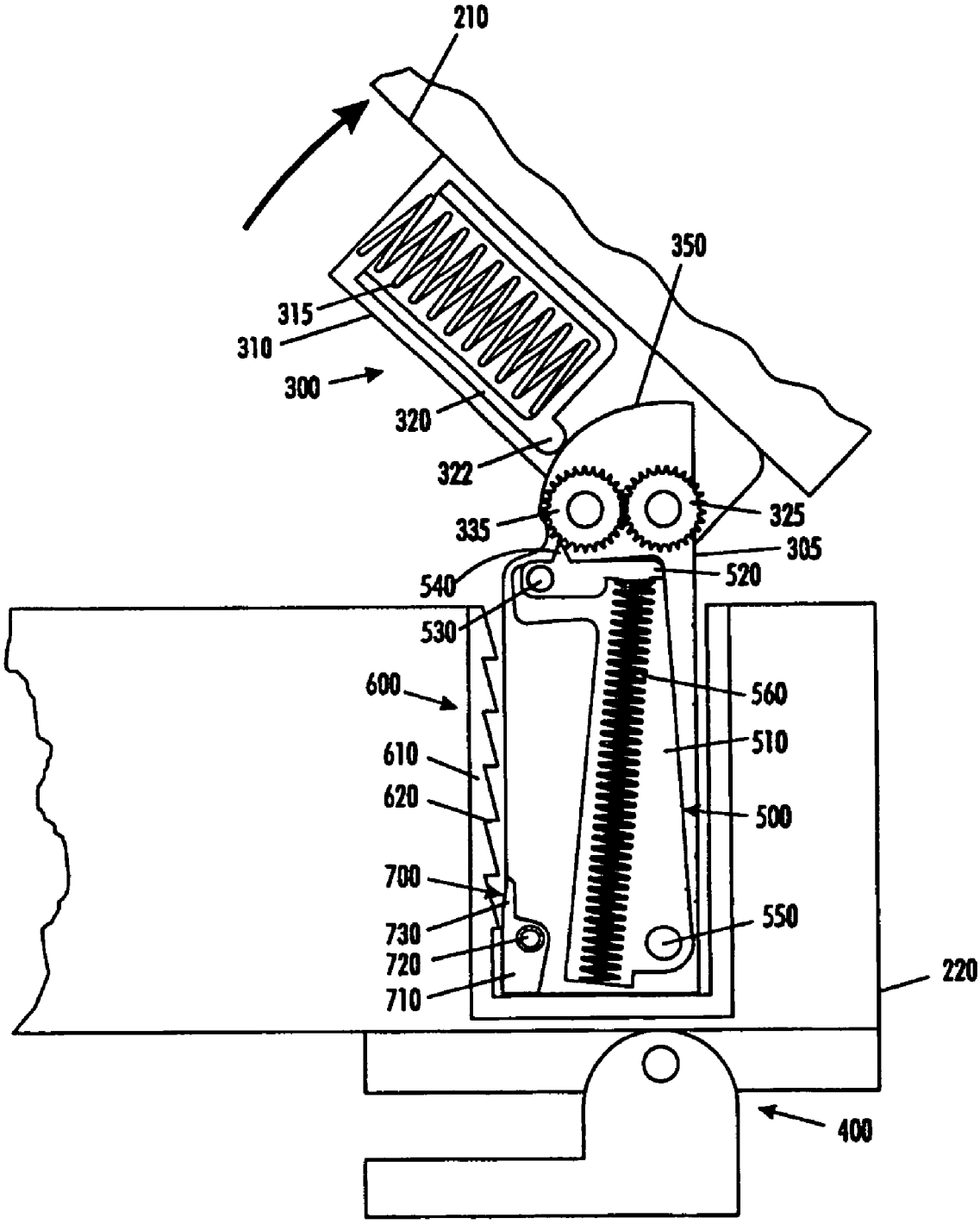
FIG. 12 illustrates a partial cut-away view of an upper hinge assembly according to a preferred embodiment in a raised position and the lower unit of the reprographic device being in a substantially horizontal position.
Figure 13:
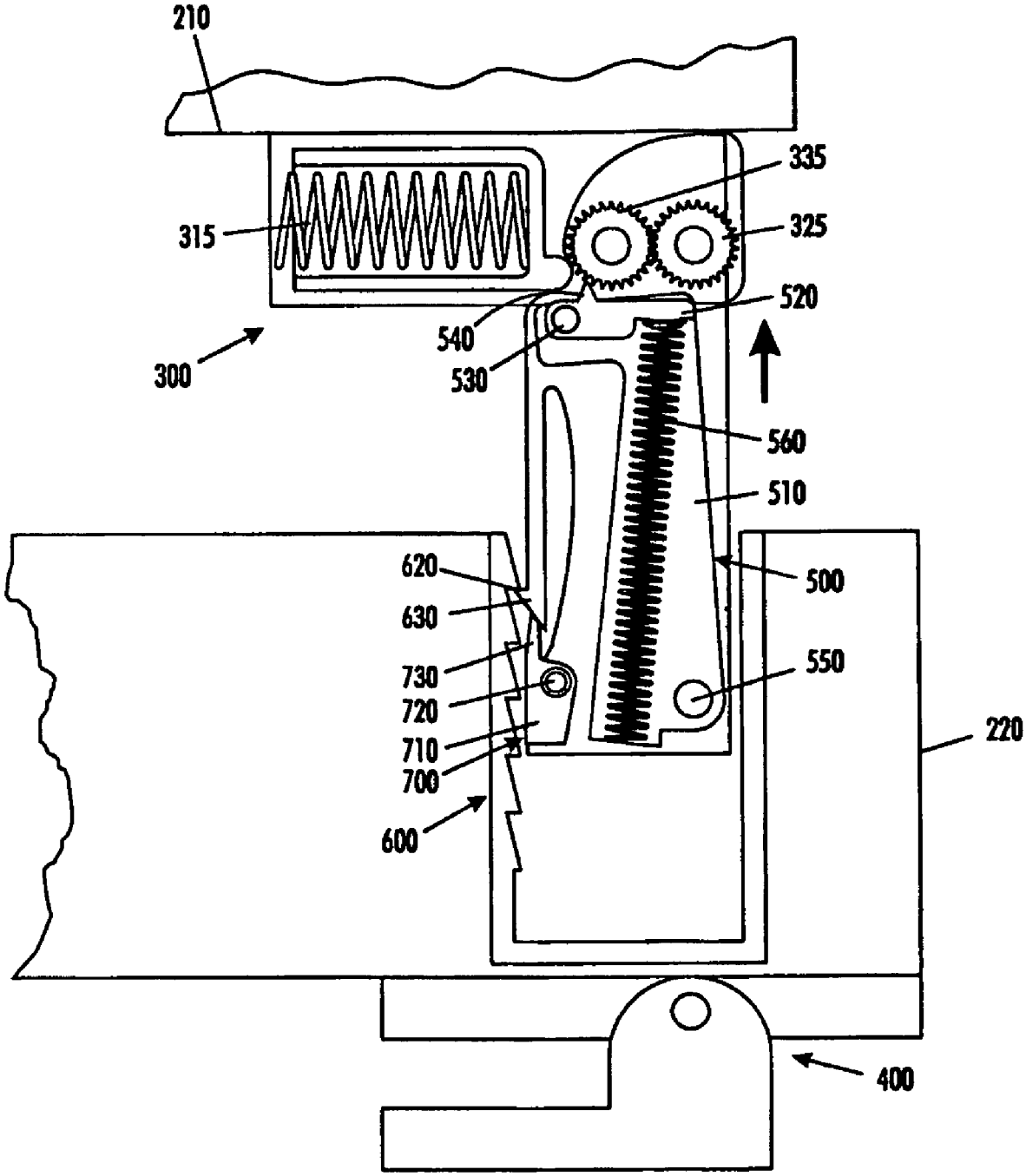
FIG. 13 illustrates a partial cut-away view of an upper hinge assembly according to a preferred embodiment in a closed, horizontal position and an elevated slide unrestrained from vertical movement but restrained from unintended removal.

As also shown in FIG. 12, elevator slide mechanism 600 is positioned in a first substantially vertical orientation. Slide mechanism 600 includes vertical side walls 610, of which at least one wall includes a series of teeth or latch elements 620. In this normal orientation, second motion lock 700 is naturally oriented by gravitational force and lock shape to a first position out of engagement with teeth elements 620. In this position, the elevator slide mechanism 600 is capable of at least limited vertical movement as shown in FIG. 13 to accommodate the positioning of books or the like on the platen surface of the lower scan unit 220. However, it may be desirable to provide a releasable mating latch element 630 that at least engages with an uppermost one of the latches 620 or other upper catch feature so that the upper unit is not inadvertently removable during normal operation. However, such a latch element 630 may be manually releasable to enable full removal, for maintenance or replacement purposes. Thus, when the lower unit 220 is closed, the upper unit 210 is freely movable in rotation and translation.

When the lower unit 220 is positioned in a non-horizontal orientation, however, as shown in FIG. 14, the first and second motion locks 500, 700 engage. That is, in this orientation, gravity rotates second motion lock 700 to a position in engagement with one of the teeth 620. This temporarily locks the elevator slide mechanism 600 from further translation. Then, upon return of the lower scan unit 220 to the closed (i.e., substantially horizontal) position, gravity will return the second motion lock 700 to the non-engaged position automatically.

Thus, the upper feeder unit 210 can be prevented from sliding outwardly or extending when the lower scan unit 220 is raised through use of a pivoting weighted pawl serving as second motion lock 700. However, to retain elevator operation when the lower scan unit 220 is closed using a gravity-actuated pivot, the pivot lock is inhibited merely by return of the lower scan unit 220 to the closed position. Multiple catches or teeth 620 are preferably provided to prevent further elevation motion should the feeder unit 210 be partially elevated when the scanner unit 220 is lifted.

Additionally, while the lower scan unit 220 is in a non-horizontal orientation, the first motion lock 500 automatically engages. Again, actuation may be gravity fed, with the center of gravity of the pivot automatically moving the first motion lock into engagement with gear 335 when the lower scan unit 220 is rotated. In a preferred embodiment, pivot lock 540 is shaped so as to be received between adjacent teeth of gear 335. This will lock the gear 335 from further rotation, which locks the upper feeder unit 210 from rotation as well. Spring 560 provides a sufficient force on the pivot arm 520 to restrain the pivot lock 540 in engagement with gear 335 against gravitational and casual user induced rotational forces on the upper pivoting unit 210.

Thus, whenever the lower scan unit 220 is rotated, the upper feeder unit 210 can be automatically locked from independent rotation. Accordingly, the upper unit is at least partially dependent on the orientation of the lower unit.

Figure 15:
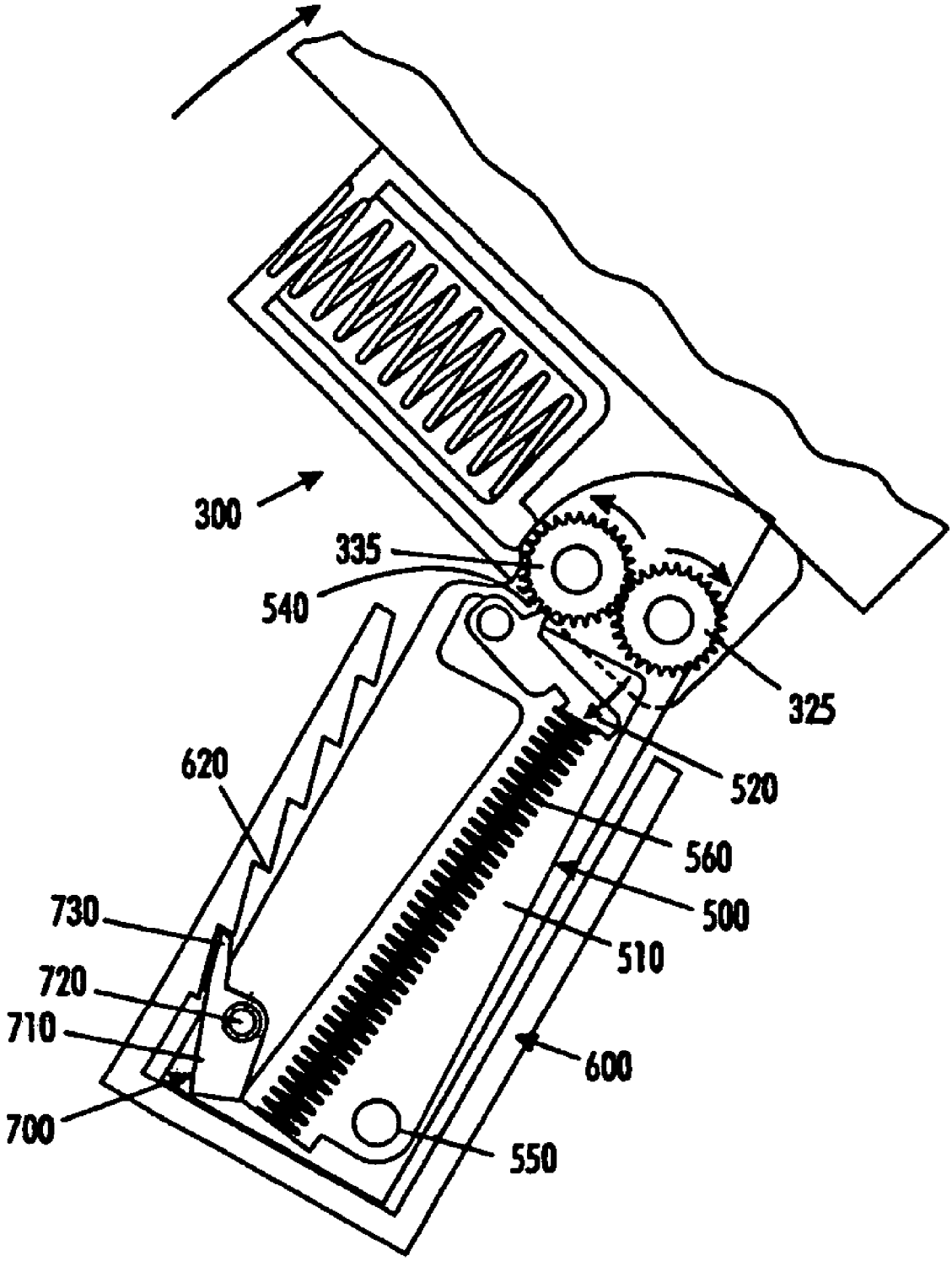
FIG. 15 illustrates a partial cut-away view of the upper hinge assembly of FIG. 14 with an override mechanism activated upon receipt of a sufficient leverage force acting on the upper unit that overrides the first motion lock mechanism and allows rotation of the upper unit relative to the lower unit.

An additional feature will be described with reference to FIG. 15. As mentioned previously, because of the typical large geometry of the feeder unit, a large leverage advantage and torque can be applied to the upper unit 210. This may inadvertently damage or break the lock, hinge or other related components. To overcome this, a lock override function is provided that yields to excessive force without causing any damage. The yield condition is enabled by spring 560, which initially provides a preload force to hinder gear tooth cam out between pivot lock 540 and gear 335. In particular, when excessive force F is applied to 210 when 220 is in the non-horizontal position, the gears 325 and 335 try to rotate against the restraining force applied by the interference of 540 with 335. At some force level, the spring 560 will yield and allow the rotation lock 540 to disengage and then reengage the next tooth. Thus, during overriding there will be a noise of teeth skipping that may alert the user to desist in application of excessive force. Furthermore, exemplary overrides are automatically reset upon removal of the damaging force. Additionally, it is preferable that the override be inhibited when the lower scan unit 220 is in the substantially horizontal position. This ensures free pivoting of the upper device 210.

A number of methods of accomplishing the lock and override can be used. One solution is to use opposing plates with a series of radial beveled "teeth" that are held in contact by spring loading one plate against the other. When sufficient rotation force is applied to the pivotal plate, it cams out of contact with the stationary plate, resulting in a desired override. However, this requires a linkage between a stationary frame and the pivoting structure of the hinge such that the plate engagement does not occur until the lower scan housing 220 is pivoted an elevated distance for actuation.

Another method eliminates the need for connections outside the hinge by using a pivoting mass internal to the hinge assembly 300 that gravitationally actuates the mechanism as the structure pivots upward. This is shown in FIG. 15. One way to create a lock and the gravity actuator is to use a wrap spring that grabs a centrally pivoting shaft but then allows an override function by slipping against the high friction as greater force is applied. The pivoting weight releases a slight wrap tension change necessary to allow free pivot motion of the feeder unit when the scanner unit is closed. This solution requires very tight tolerance control.

Another solution is to use a toggle and slide friction lock that similarly yields to sufficiently high force loads to accomplish the override. The toggle is brought into contact or held away from contact with the slider by the pivoting weight to engage or release the lock. This can be further refined by inclusion of a high force spring loading back up plate that limits slide force to provide a specific force window for the override slippage.

Ideally, the various locks and override structure are incorporated into the hinge itself, so that external linkages, manual release latches and catches that would otherwise interfere with operation of the device, such as copying or "original" document placement, can occur without obstruction. Thus, it is preferable that the various motion locks are internal to the hinge and neatly incorporated into an "envelope" formed from the various hinge component housings.

Figure 16:
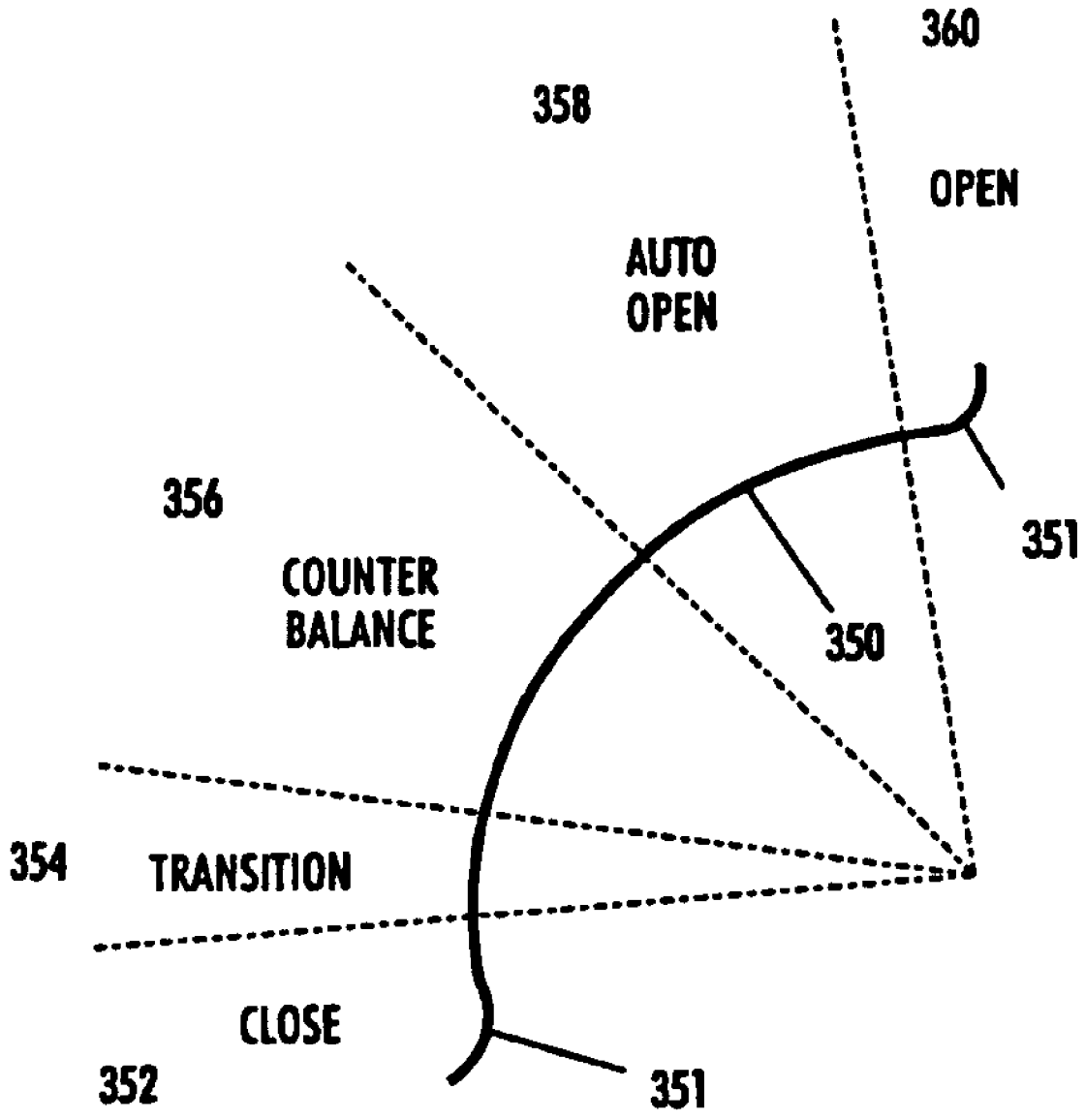
FIG. 16 illustrates major hinge cam positions achieved by an exemplary hinge assembly.

An exemplary hinge assembly 300 is of the detent and counterbalance type that provides detent, counterbalancing and motion/mass control functions as better shown in FIG. 16. Similar functionality can be provided in lower hinge assembly 400. This functionality can be provided in many ways. In the illustrated embodiment using hinge assembly 300 from the FIG. 11 embodiment, spring loading plunger 320 using spring 315 against profiled cam surface 350 provides the necessary detent and counterbalance functionality. Cam profile 350 may include a closed position 352, a transition range 354, a counterbalance range 356, an auto open range 358, and an open position 360 as shown. Detent positions 352 and 360 can be set at predetermined angular locations and have an overtravel profile contour 351 that requires a noticeably higher force to remove the hinge assembly from these first and second end positions. These detent positions 352, 360 thus cause a condition where additional motion or overtravel can occur only by supplying a noticeably higher force. Overtravel force and travel range are intentionally incorporated and are exclusive of system flexure against a "hard" stop. Moreover, the profile preferably tightly constrains the hinge assembly in these positions. This may be achieved, for example, by providing a cam profile with a detent, a condition where additional motion or overtravel can occur only by supplying a noticeably higher force.

The intermediate position defined as the counterbalance range 356 is preferably provided with a cam profile and spring force that counterbalances the weight and leverage of the upper unit so that the unit can be left at an intermediate position without requiring a user force for retention. That is, the hinge assembly is designed at this position to approximately neutralize the force of gravity so the unit will remain stationary if there are no external stabilizing or motion forces.

It is further preferable to provide the auto open range 358 with a cam profile complementary to the spring force that provides an urging force to bias the upper pivoting unit toward the fully open position 360. This provides an operator with tactile feedback that assists in positioning of the pivoting unit to the full intended open position 360. The urging force does not have to be so strong that it achieves full open functionality without further user assistance, but results in at least a lessening of the urging force needed by the operator to open the unit.

The numeric range for the various positions can be determined based on user preference and device-specific constraints. All functions or any number of combinations of functions described may be employed in the hinge or omitted depending on the mass and desired function of the units involved.

While aspects of the invention have been described in conjunction with the exemplary embodiments outlined above, various alternatives, modifications, variations, and/or improvements, whether known or that are, or may be, presently unforeseen, may become apparent. Accordingly, the exemplary embodiments of the invention as set forth above are intended to be illustrative, not limiting. Various changes may be made without departing from the spirit and scope of the invention. Therefore, the systems and methods described are intended to embrace all known, or later-developed, alternatives, modifications, variations, and/or improvements.

What is claimed is:

1. A hinge pivot and motion lock for tandemly coupled upper and lower pivoting functional units, comprising:

a lower pivoting functional unit positionable between a first substantially horizontal position and a second non-horizontal position;

an upper pivoting functional unit positionable between a first substantially horizontal position and a second non-horizontal position;

a hinge assembly coupling the upper pivoting functional unit to the lower pivoting functional unit and including a gear member allowing at least pivotal movement of the upper pivoting functional unit relative to the lower pivoting functional unit; and at least one gravity-actuated motion lock that engages the gear member to inhibit movement of the upper pivoting functional unit relative to the lower pivoting functional unit when the lower pivoting functional unit is in the second non-horizontal position and disengages from the gear member when the lower pivoting functional unit is positioned at the first substantially horizontal position.

2. The hinge pivot and motion lock according to claim 1, wherein the motion lock when gravity-actuated inhibits rotation of the upper pivoting functional unit relative to the lower pivoting functional unit by locking the gear member of the hinge assembly.

3. The hinge pivot and motion lock according to claim 1, wherein the hinge assembly includes an elevator slide mechanism that allows translation of the upper pivoting functional unit relative to the lower pivoting functional unit and the motion lock when gravity-actuated inhibits translation of the upper pivoting functional unit relative to the lower pivoting functional unit by locking the elevator slide mechanism.

4. The hinge pivot and motion lock according to claim 1, wherein the at least one motion lock includes a first motion lock that, when gravity-actuated, inhibits rotation of the upper pivoting functional unit relative to the lower pivoting functional unit and a second motion lock that, when gravity-actuated, inhibits translation of the upper pivoting functional unit relative to the lower Pivoting functional unit, further wherein the upper pivoting functional unit is coupled to the lower pivoting functional unit through an elevator slide mechanism having a first wall with at least one latch element and the second motion lock includes a body portion pivotally mounted for rotation about a pivot shaft and having an engagement portion, wherein when the lower pivoting functional unit is in the first horizontal position, the engagement portion is displaced from the latch of the elevator slide mechanism, allowing free translational movement of the upper pivoting functional unit relative to the lower pivoting functional unit, and when the lower pivoting functional unit is moved to the second non-horizontal position, the engagement portion moves into contact with the at least one latch of the elevator slide mechanism to inhibit translation of the upper pivoting functional unit relative to the lower pivoting functional unit.

5. The hinge pivot and motion lock according to claim 1, wherein the at least one motion lock is self-actuating and self-releasing by movement of the lower pivoting functional unit at a point prior to the second position.

6. The hinge pivot and motion lock according to claim 1, wherein the hinge assembly includes an upper pivoting housing and a lower pivoting housing and the at least one motion lock is confined within at least one of the upper housing and the lower housing so that the at least one motion lock condition is established internal to the hinge assembly.

7. The hinge pivot and motion lock according to claim 1, wherein the upper pivoting functional unit is positionable to multiple non-horizontal positions by rotation of the gear member, the gear member including a gear rotatable about a first axis and having a series of teeth around at least an arc of the circumference, the at least one motion lock including a pivot housing pivotal about a second axis different from the first axis and a pivot arm having a pivot lock matable with at least one gear tooth of the gear, further wherein movement of the lower pivoting functional unit self-actuates the pivot lock of the at least one motion lock into or out of engagement with at least one gear tooth of the gear to inhibit motion of the upper pivoting functional unit relative to the lower pivoting functional unit and lock the upper pivoting functional unit at one or more different positions depending on the position of the lower Pivoting functional unit.

8. The hinge pivot and motion lock according to claim 7, further comprising a lock override mechanisms operatively coupled to the motion lock, wherein when an excessive external rotational force is exerted on the upper pivoting functional unit, the lock override mechanism yields to the excessive external force to override the at least one gravity-actuated motion lock and disengage the motion lock from the gear member to reduce damage to the hinge pivot or upper pivoting functional unit.

9. The hinge pivot and motion lock according to claim 8, wherein the lock override mechanism includes a spring-biased pivot arm that yields to the excessive external force to at least momentarily release contact between the pivot lock and the gear of the gear member.

10. The hinge pivot and motion lock according to claim 9, wherein upon a reduction in the excessive external force to below a predetermined force the spring-biased pivot arm provides an urging force that reengages the pivot lock to the gear to reestablish an engaged motion lock.

11. The hinge pivot and motion lock according to claim 1, further comprising a lock override mechanism, operatively coupled to the motion lock, wherein when an excessive external rotational force is exerted on the upper pivoting functional unit, the lock override mechanism that-yields to the excessive external force to override and disengage the at least one motion lock from the gear member to allow movement to reduce damage to the hinge pivot or upper pivoting functional unit from the excessive external force.

12. The hinge pivot and motion lock according to claim 11, wherein the lock override mechanism automatically resets to reengage the at least one motion lock when the excessive external force is reduced to below a predetermined force.

13. A reprographic device comprising:

a base functional unit on which is operably mounted an upper pivoting functional unit;

a lower pivoting functional unit; and the hinge pivot and motion lock of claim 1.

14. The reprographic device according to claim 13, wherein the lower pivoting functional unit includes a scanning unit for scanning an image.

15. The reprographic device according to claim 14, wherein the upper pivoting functional unit includes a marking media feeding unit.

16. The reprographic device according to claim 14, wherein the upper pivoting functional unit includes a scanning unit document cover.

17. The reprographic device according to claim 13, wherein the upper pivoting functional unit is rotatable and translatable relative to the lower pivoting functional unit and the at least one motion lock inhibits rotation and translation of the upper pivoting functional unit relative to the lower pivoting functional unit when the lower pivoting functional unit is positioned in the second non-horizontal position.

18. A hinge pivot and motion lock for tandemly coupled upper and lower pivoting functional units, comprising:

a lower pivoting functional unit positionable between a first substantially horizontal position and a second non-horizontal position;

an upper pivoting functional unit positionable between a first substantially horizontal position and a second non-horizontal position;

a hinge assembly coupling the upper pivoting functional unit to the lower pivoting functional unit and including a gear member allowing at least pivotal movement of the upper pivoting functional unit relative to the lower pivoting functional unit; and at least one gravity-actuated motion lock that engages the gear member to inhibit rotation of the upper pivoting functional unit relative to the lower pivoting functional unit when the lower pivoting functional unit is in the second non-horizontal position and disengages from the gear member when the lower pivoting functional unit is positioned at the first substantially horizontal position, wherein the at least one gravity-actuated motion lock is self-actuating and self-releasing by movement of the lower pivoting functional unit between the first and second positions.

19. A hinge pivot and motion lock for tandemly coupled upper and lower pivoting functional units, comprising:

a lower pivoting functional unit positionable between a first substantially horizontal position and a second non-horizontal position;

an upper pivoting functional unit positionable between a first substantially horizontal position and a second non-horizontal position;

a hinge assembly coupling the upper pivoting functional unit to the lower pivoting functional unit and including a gear member allowing at least pivotal movement of the upper pivoting functional unit relative to the lower pivoting functional unit;

at least one gravity-actuated motion lock that engages the lower pivoting functional unit to inhibit translation of the upper pivoting functional unit relative to the lower pivoting functional unit when the lower pivoting functional unit is in the second non-horizontal position and disengages from the lower pivoting functional unit when the lower pivoting functional unit is positioned at the first substantially horizontal position; and the at least one gravity-actuated motion lock is self-actuating and self-releasing by movement of the lower pivoting functional unit between the first and second positions, wherein the lower pivoting functional unit includes an elevator slide mechanism having a first wall with at least one latch element and a body portion pivotally mounted for rotation about a pivot shaft and having an engagement portion, and when the lower pivoting functional unit is in the first horizontal position, the engagement portion is displaced from the latch element of the elevator slide mechanism, allowing free translational movement of the upper pivoting functional unit relative to the lower pivoting functional unit, and when the lower pivoting functional unit is moved to the second non-horizontal position, the engagement portion moves into contact with the at least one latch element of the elevator slide mechanism to inhibit translation of the upper pivoting functional unit relative to the lower pivoting functional unit.

* * * * *